US008091883B2

(12) United States Patent
Sakamoto

(10) Patent No.: US 8,091,883 B2
(45) Date of Patent: Jan. 10, 2012

(54) SHEET FEEDING DEVICE AND IMAGE FORMING APPARATUS

(75) Inventor: Kouki Sakamoto, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 12/805,001

(22) Filed: Jul. 7, 2010

(65) Prior Publication Data

US 2011/0049782 A1 Mar. 3, 2011

(30) Foreign Application Priority Data

Aug. 26, 2009 (JP) ..... 2009-195076
May 27, 2010 (JP) ..... 2010-121467

(51) Int. Cl.
*B65H 3/44* (2006.01)

(52) U.S. Cl. ..... 271/9.13; 271/9.01; 271/272

(58) Field of Classification Search ..... 271/9.01, 271/9.13, 272
See application file for complete search history.

(56) References Cited

U.S. PATENT DOCUMENTS 5,199,694 A * 4/1993 Iseda ..... 271/9.05
6,062,557 A * 5/2000 Kusumi ..... 271/10.13
6,438,351 B2 * 8/2002 Kawachi et al. ..... 399/394
2008/0203649 A1 * 8/2008 Watase et al. ..... 271/9.13
2009/0066007 A1 * 3/2009 Sugiyama ..... 271/9.01
2009/0236791 A1 * 9/2009 Chino ..... 271/9.01

FOREIGN PATENT DOCUMENTS

JP 2001-146338 5/2001

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

The sheet feeding device includes a straight sheet feeding passage, and plural sheet feeding sections. Each sheet feeding section includes a container containing a stack of sheets; a driving rotor; a first driven rotor contacting the driving rotor to form a first nip; a feeding member feeding the sheet from the container toward the first nip; and a second driven rotor contacting the driving rotor or the first driven rotor to form a second nip at the junction of the sheet feeding section and the sheet feeding passage. Only the sheet feeding section on the extreme upstream side has a curved guide instead of the second driven rotor to directly feed the sheet to the second nip of the adjacent sheet feeding section so that the sheet at the curved guide has greater curvature radius than the sheet fed from the other sheet feeding sections toward the second nip thereof.

6 Claims, 10 Drawing Sheets

SHEET FEEDING DEVICE AND IMAGE FORMING APPARATUS

BACKGROUND OF THE INVENTION

1. Field of the Invention

The present invention relates to a sheet feeding device for feeding a sheet. More particularly, the present invention relates to a sheet feeding device, which has a straight sheet feeding passage and plural sheet feeding sections, each of which feeds a sheet while curving the sheet so that the sheet enters the straight sheet feeding passage. In addition, the present invention also relates to an image forming apparatus, such as a copier, printer, facsimile machine, or the like, having the sheet feeding device.

2. Discussion of the Related Art

Conventionally, image forming apparatuses like that shown in FIG. 1 are known.

FIG. 1 is a schematic view illustrating the sheet feeding device of such related-art image forming apparatus. Referring to FIG. 1, it can be seen that the sheet feeding device is arranged at the bottom of the image forming apparatus, and has three sheet feeding sections, i.e., first, second, and third sheet feeding sections. The first sheet feeding section includes a first sheet cassette 901, which is detachably attachable to the chassis of the image forming apparatus, and a first roller unit 904A arranged on the right side of the first sheet cassette. Similarly, the second sheet feeding section includes a second sheet cassette 902, which is detachably attachable to the chassis of the image forming apparatus, and a second roller unit 904B arranged on the right side of the second sheet cassette. The third sheet feeding section includes a large-capacity sheet cassette 903, and a third roller unit 904C arranged on the right side of the large-capacity sheet cassette.

As illustrated in FIG. 1, the first and second sheet cassettes 901 and 902, each of which serves as a sheet container for containing sheets P, are arranged in such a manner that the second sheet cassette is located above the first sheet cassette. The large-capacity sheet cassette 903, which can contain a large number of sheets P, is arranged above the second sheet cassette 902. Each of the right side portions of the first, second, and third roller units 904A, 904B and 904C defines a portion of a vertical sheet feeding passage 920, through which the sheet P is vertically fed from the lower side thereof to the upper side thereof.

FIG. 2 is an enlarged view illustrating only the second roller unit 904B of the sheet feeding device illustrated in FIG. 1 among the three roller units. Referring to FIG. 2, the second roller unit 904B includes a pickup roller 902*a*, a feed roller 905B, a reverse roller 906B, a grip roller 907B, a first driven roller 908B, a second driven roller 909B, etc. The uppermost sheet of the sheets P contained in the second sheet cassette 902 is fed out by the rotated pickup roller 902*a* so as to enter a separation nip formed by the feed roller 905*b* and the reverse roller 906B. If multiple sheets are fed simultaneously from the sheet cassette 902, the sheets are separated at the separation nip so that only the uppermost sheet passes through the separation nip. The thus-fed sheet P then enters a first nip N1 formed by the grip roller 907B rotated counterclockwise by a driving device (not shown) and the first driven roller 908B, which is contacted to the grip roller so as to rotate while being driven by the grip roller. As illustrated in FIG. 2, that portion of the sheet feeding passage which extends from the pickup roller 902*a* to the first nip N1 is slightly slanted upward in the sheet feeding direction.

Not only the first driven roller 908B but also the second driven roller 909B is contacted to the grip roller 907B, although at a different position from that of the first driven roller 908B. The second driven roller 909B is contacted to the grip roller 907B from the right side to form a second nip N2. The second nip N2 forms a portion of the vertical sheet feeding passage 920, which substantially vertically feeds the sheet P from the lower side thereof to the upper side thereof. The sheet P passing through the first nip N1 formed by the grip roller 907B and the first driven roller 908B and entering the vertical sheet feeding passage 920 strikes the second driven roller 909B. The sheet P is then sharply curved by the clockwise rotating second driven roller 909B so as to face upward and enter the second nip N2 formed by the grip roller 907B and the second driven roller. The sheet P is then fed upward through the vertical sheet feeding passage 920.

The second roller unit 904B has been described by reference to FIG. 2. The first and third roller units 904A and 904C have substantially the same configuration as the second roller unit 904B.

Although capable of handling ordinary sheets of paper or the like, the above-described configuration can have problems handling thicker media because such sheets are naturally stiffer, more rigid, and less easy to bend or curve. Thus, when a thick sheet having high stiffness is used as the sheet P in a sheet feeding device having such configuration as mentioned above, the sheet cannot be sharply curved by the second driven roller, often resulting in jamming of the sheet at the entrance of the vertical sheet feeding passage. For example, in the second roller unit 904B illustrated in FIG. 2, it is hard to sharply curve a thick sheet, which passes through the first nip N1 formed by the grip roller 907B and the first driven roller 908B and strikes the second driven roller 909B, so that the sheet faces upward in the vertical sheet feeding passage 920. Therefore, the sheet jamming problem tends to arise at the entrance to the second nip N2.

In order to prevent occurrence of the above-described sheet jamming problem, it is to be possible to feed such a thick sheet, which has passed through the first nip N1, along a curved passage having a large curvature radius so that the sheet changes the feeding direction little by little. However, since such a curved passage occupies much space, the image forming apparatus would become unacceptably large.

Hereinbefore, the sheet jamming problem caused in a sheet feeding device in which a sheet fed from a sheet cassette is curved so as to face upward in a vertical sheet feeding passage has been described. Such a jamming problem is caused not only in such a sheet feeding device, but also in sheet feeding devices in which a sheet fed from one of plural sheet cassettes is curved soon after entering a straight sheet feeding passage so as to be fed to the downstream side in the straight sheet feeding passage.

For these reasons, there is a need for a sheet feeding device which can properly curve a thick sheet fed from a sheet cassette at an entrance of a straight sheet feeding passage to securely feed the thick sheet to the downstream side in the straight sheet feeding passage without causing the sheet jamming problem.

SUMMARY

This patent specification describes a novel sheet feeding device, one embodiment of which includes a straight sheet feeding passage and plural sheet feeding sections configured to contain a stack of sheets and to feed a sheet to the straight sheet feeding passage, wherein the sheet fed from each of the plural sheet feeding sections is curved when the sheet enters the straight sheet feeding passage.

Each of the plural sheet feeding sections includes a sheet container containing the stack of sheets, a driving rotor, a first driven rotor contacted to the driving rotor to form a first nip, a feeding member configured to feed a sheet from the sheet container toward the first nip, and a second driven rotor contacted to the driving rotor or the first driven rotor to form a second nip, wherein the second nip is shared with the straight sheet feeding passage.

When the sheet fed by the feeding member and passing through the first nip enters the straight sheet feeding passage, and strikes the second driven rotor in each sheet feeding section, the sheet is curved by the second driven rotor so as to be guided to the second nip thereof by the second driven rotor, so that the sheet is fed through the straight sheet feeding passage toward the downstream side relative to the sheet feeding direction.

Among the plural sheet feeding sections, only the sheet feeding section located on the extreme upstream side relative to the sheet feeding direction does not have the second driven rotor, but has a curved guide portion, along which the sheet fed from the sheet feeding section is directly fed to the second nip of the adjacent sheet feeding section while having a greater curvature radius than the sheet fed from the other sheet feeding sections to the second nip thereof.

This patent specification further describes a novel image forming apparatus. In one embodiment, the image forming apparatus includes the above-mentioned sheet feeding device configured to feed a sheet, and an image forming device configured to form an image on the sheet fed from the sheet feeding device.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

Figure 1:
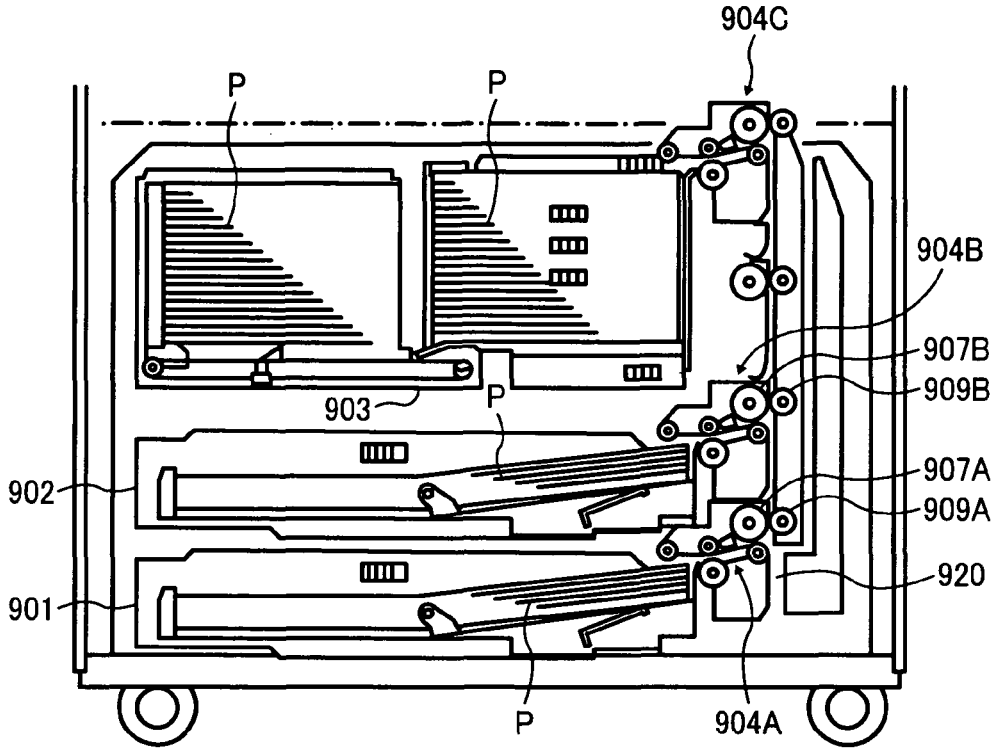
FIG. 1 RELATED ART
FIG. 1 is a schematic view illustrating a related-art sheet feeding device.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. maybe used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

The present description begins with the fact that, among the three sheet feeding sections illustrated in FIG. 1, only the first sheet feeding section is different from the other sheet feeding sections in that the function of the second driven roller of the first sheet feeding section is only to curve a sheet. By contrast, the second driven rollers of the other sheet feeding sections have two functions, to curve a sheet, which has passed the first nip, upward as mentioned above, and to receive a sheet fed from the second nip of the adjacent sheet feeding section located directly below the sheet feeding section.

Figure 2:
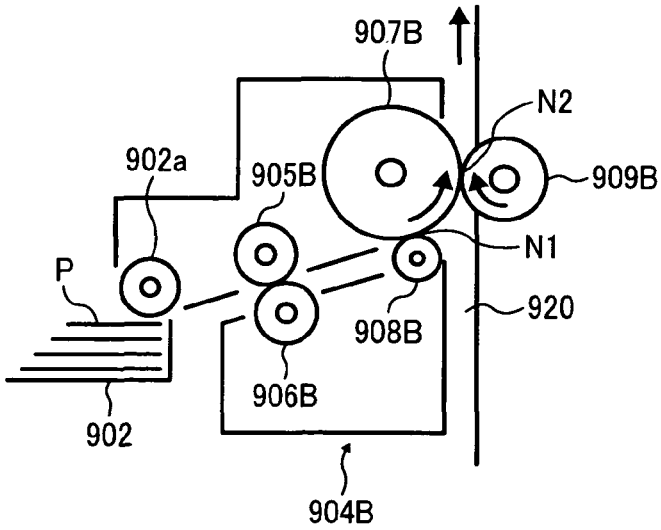
FIG. 2 RELATED ART
FIG. 2 is an enlarged view illustrating the second roller unit of the related-art sheet feeding device illustrated in FIG. 1.

For example, referring to FIG. 2 illustrating the second sheet feeding section 904B, the second nip of the first sheet feeding section 904A (shown in FIG. 1) is present directly below the second nip N2 of the second sheet feeding section 904B formed by the grip roller 907B and the second driven roller 909B. The second driven roller 909B and the grip roller 907B of the second sheet feeding section 904B illustrated in FIG. 2 receives a sheet fed from the second nip of the first sheet feeding section 904A (shown in FIG. 1).

However, referring to FIG. 1, there is no sheet feeding section directly below the first sheet feeding section 904A. Therefore, it is not necessary for the second driven roller 909A of the first sheet feeding section 904A to receive a sheet fed from beneath. Namely, the function of the second driven roller 909A of the first sheet feeding section 904A is only to curve a sheet fed from the first nip thereof, i.e., to sharply curve a sheet fed from the first nip thereof upward at the junction of the first sheet feeding section with the vertical sheet feeding passage 920 so that the sheet enters the second nip formed by the grip roller 907A and the second driven roller 909A of the first sheet feeding section 904A.

In this regard, if the sheet is slightly curved along a curved passage having a large curvature radius, it is not necessary to provide the second driven roller 909A. By removing the second driven roller 909A, such a curved passage having a large curvature radius can be provided in the space used for the second driven roller (i.e., in a space on the right side of the grip roller 907A).

The image forming apparatus of the present invention will now be described in detail by reference to an example, which is an electrophotographic copier.

At first, the basic configuration of the copier will be described.

Figure 3:
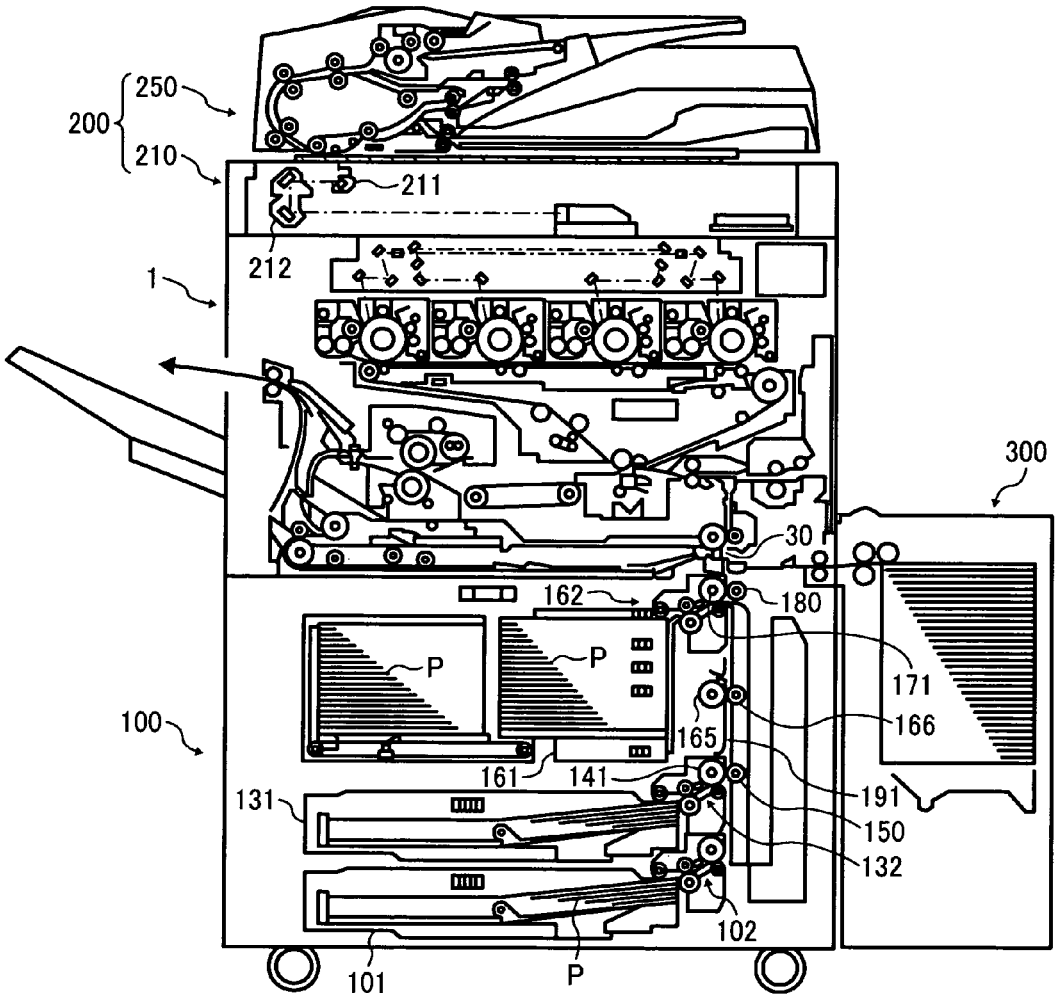
FIG. 3 is a schematic view illustrating a copier as one example of the image forming apparatus of the present invention.

FIG. 3 is a schematic view illustrating the copier. The copier includes a printer section 1, a sheet feeding device 100, and an original document feeding/reading unit 200. The original document feeding/reading unit 200 has a scanner 210 which is fixed on the printer section 1 and which serves as an original image reading device configured to read an image of an original document, and an automatic document feeder (ADF) 250, which is supported by the scanner and which serves as an original document sheet feeding device configured to feed an original document sheet to the scanner. In this copier, the original document sheet feeding device and the printer section 1 serve as an image forming device for forming a visual image on a receiving sheet.

The copier can optionally include an external sheet feeding device 300, which contains a large number of receiving sheets and feeds the sheets to the printer section 1 one by one.

The sheet feeding device 100 is arranged below the printer section 1, which will be described later in detail, and has three sheet feeding sections, i.e., first, second and third sheet feeding sections. The first sheet feeding section includes a first sheet cassette 101, and a first roller unit 102. The second sheet feeding section includes a second sheet cassette 131, and a second roller unit 132. The third sheet feeding section includes a large-capacity sheet tray 161, and a third roller unit 162.

The first and second sheet cassettes 101 and 131 are detachably attachable to the main body of the copier, and the second sheet cassette is located above the first sheet cassette. The large-capacity sheet tray 161 is located above the second sheet cassette 131. In addition, a vertical sheet feeding passage 191, which serves as a straight sheet feeding passage and which is configured to feed a receiving sheet from the lower side thereof to the upper side thereof, is arranged on the right side of the first sheet cassette 101, second sheet cassette 131 and large-capacity sheet tray 161. Each of the first sheet cassette 101, second sheet cassette 131, and large-capacity sheet tray 161 contains a stack of receiving sheets P, and feeds the receiving sheets one by one upon receipt of a control signal from the printer section 1. The thus-fed receiving sheet P is then fed from the lower side of the vertical sheet feeding passage 191 to the upper side thereof so as to be fed to a sheet feeding passage 30 in the printer section 1.

Three pairs of rollers (141, 150) (165, 166) and (171, 180), in which the rollers are contacted to each other in each pair of rollers, are arranged in the vertical sheet feeding passage 191 as illustrated in FIG. 3. The receiving sheet P is fed through the vertical sheet feeding passage 191 while sandwiched by the rollers at the nips. Specifically, the first nip of the vertical sheet feeding passage 191 is formed by a grip roller 141 (serving as a driving rotor) and a second driven roller 150 (serving as a second driven rotor), which are arranged on the right side of the second sheet cassette 131, and is the second nip of the second roller unit 132. The second nip of the vertical sheet feeding passage 191 is formed by a feeding roller 165 and a driven roller 166. The third nip of the vertical sheet feeding passage 191 is formed by a grip roller 171 (serving as a driving rotor) and a second driven roller 180 (serving as a second driven rotor) of the large-capacity sheet feeding tray 161, which will be described later in detail, and is the second nip of the third roller unit 162.

In the first sheet feeding section, which is located on the lowest side among the three sheet feeding sections, the receiving sheet P fed from the first sheet cassette 101 by the first sheet feeding section enters the vertical sheet feeding passage 191. The sheet is sharply curved upward at the entrance of the vertical sheet feeding passage 191 (i.e., at the junction of the sheet feeding passage of the first sheet feeding section and the vertical sheet feeding passage) so as to be fed through the vertical sheet feeding passage. Thus, the receiving sheet P is fed toward the printer section 1. Similarly, when the receiving sheet P fed from the second sheet cassette 131 of the second sheet feeding section enters the vertical sheet feeding passage 191, the sheet is sharply curved upward at the entrance of the vertical sheet feeding passage (i.e., at the junction of the sheet feeding passage of the second sheet feeding section and the vertical sheet feeding passage) so as to be fed through the vertical sheet feeding passage, and the sheet is then fed toward the printer section 1. In addition, when the receiving sheet P fed from the large-capacity sheet feeding tray 161 of the third sheet feeding section enters the vertical sheet feeding passage 191, the sheet is sharply curved upward at the entrance of the vertical sheet feeding passage (i.e., at the junction of the sheet feeding passage of the third sheet feeding section and the vertical sheet feeding passage) so as to be fed through the vertical sheet feeding passage, and the sheet is then fed toward the printer section 1.

Figure 4:
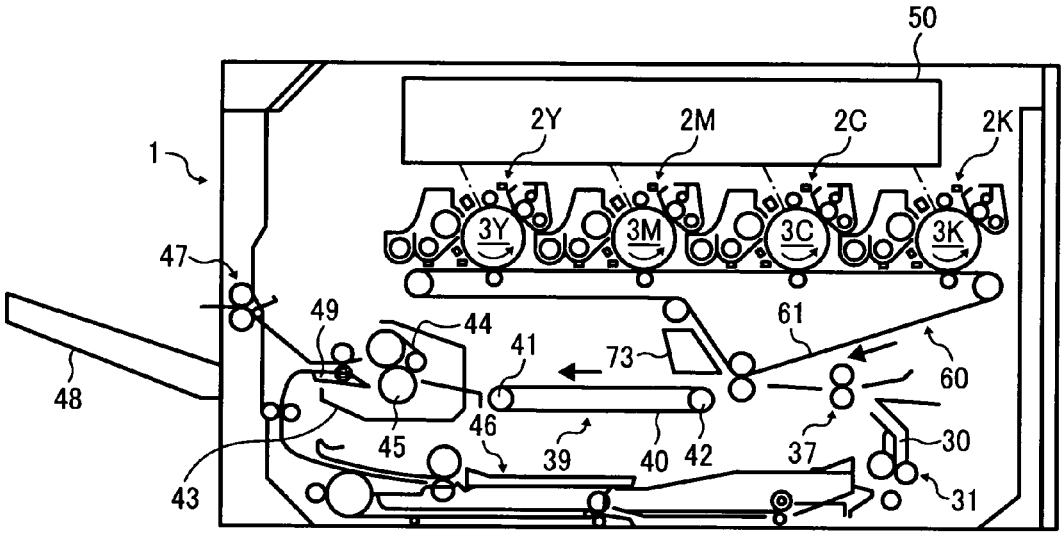
FIG. 4 is an enlarged view illustrating the printer section of the image forming apparatus illustrated in FIG. 3.

FIG. 4 is an enlarged view illustrating the printer section 1 of the copier illustrated in FIG. 3. The printer section 1 includes four process units 2Y, 2M, 2C and 2K for forming yellow (Y), magenta (M), cyan (C), and black (K) toner images, respectively. In addition, the printer section 1 includes the sheet feeding passage 30, a pair of feed rollers 31, a pair of registration rollers 37, a feed belt unit 39, a fixing unit 43, a switchback device 46, a pair of discharging rollers 47, a discharge tray 48, a switching pick 49, an optical image writing unit 50, a transferring unit 60, etc. The process units 2Y, 2M, 2C and 2K include respective photoreceptor drums 3Y, 3M, 3C and 3K, which serve as latent image bearing members.

The sheet feeding passage 30 receives the receiving sheet P from the sheet feeding device 100, and feeds the sheet toward a secondary transfer nip described later.

The optical image writing unit 50 includes a laser diode, a polygon mirror, a variety of lenses, etc., which are not shown in FIG. 4, and drives the laser diode according to image information of an original document read by the scanner 210 or image information sent from an external device such as personal computers. The optical image writing unit 50 scans the photoreceptor drums 3Y, 3M, 3C and 3K with laser beams emitted from the laser diode to form electrostatic latent images corresponding to yellow, magenta, cyan and black color images on the respective photoreceptor drums. Specifically, the photoreceptor drums 3Y, 3M, 3C and 3K are rotated by a driving device (not shown) in the directions indicated by respective arrows (i.e., counterclockwise in FIG. 4). The optical writing unit 50 irradiates each of the rotated photoreceptor drums 3Y, 3M, 3C and 3K with a laser beam (i.e., a laser beam L in FIG. 5) while deflecting the laser beam in a direction parallel to the rotation axis of the photoreceptor drum 3. By performing this optical scanning processing, electrostatic latent images according to the Y, M, C and K information of the image to be reproduced are formed on the respective photoreceptor drums 3Y, 3M, 3C and 3K.

Figure 5:
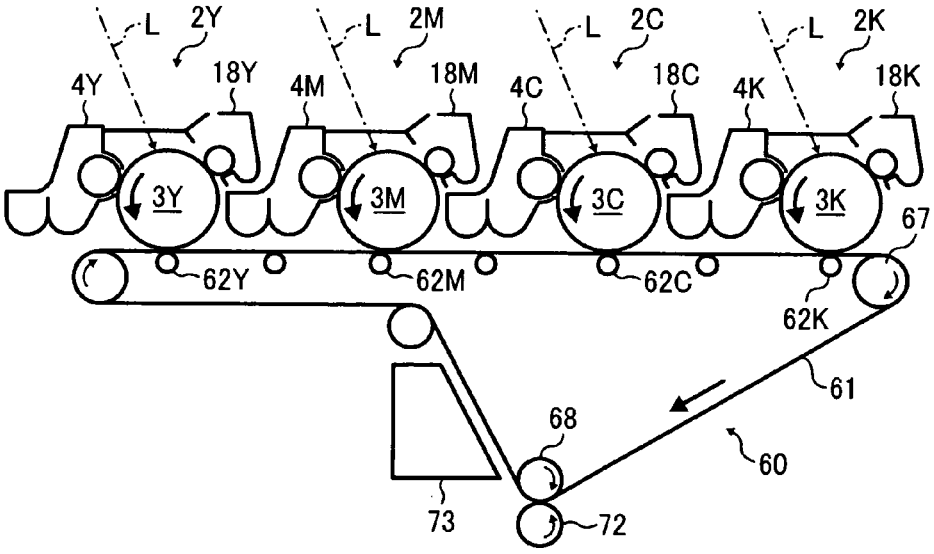
FIG. 5 is an enlarged view illustrating a portion of the printer section illustrated in FIG. 4.

FIG. 5 is an enlarged view illustrating a portion of the printer section 1. Each of the process units 2Y, 2M, 2C and 2K includes a photoreceptor, serving as a latent image bearing member, and a variety of devices arranged around the photoreceptor, wherein the photoreceptor and devices are unitized while supported by a common support. The process units 2Y, 2M, 2C and 2K are detachably attached to the main body of the printer section 1, and have the same configuration except that the color of the toner used for developing electrostatic latent images is different. For example, the process unit 2Y for forming yellow images includes the photoreceptor drum 3Y, and a developing device 4Y for developing an electrostatic latent image formed on the photoreceptor drum 3Y with a developer including a yellow toner to form a yellow toner image on the photoreceptor drum. Thus, the copier illustrated in FIG. 4 has a tandem configuration such that the four process units 2Y, 2M, 2C and 2K are arranged side by side along an endless intermediate transfer belt 61 described later.

All four process units 2Y, 2M, 2C, and 2K have essentially the same structure and function in essentially the same way, and therefore a description thereof is given below using as a representative example the process unit 2Y for forming yellow toner images.

Figure 6:
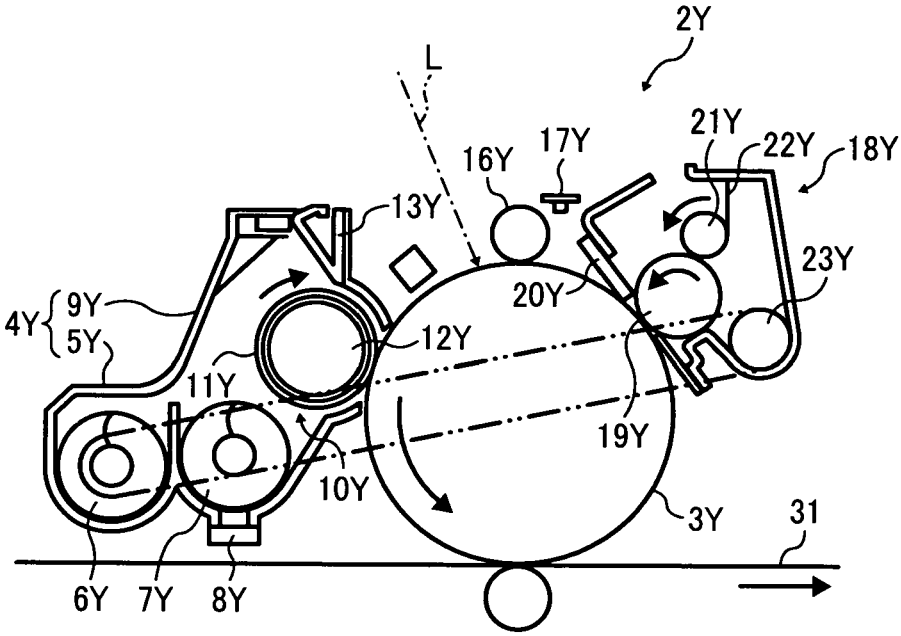
FIG. 6 is an enlarged view illustrating a process unit of the printer section, which forms a yellow image.

FIG. 6 is an enlarged view illustrating the process unit 2Y for forming yellow toner images. Referring to FIG. 6, the process unit 2Y includes the photoreceptor drum 3Y, and the developing device 4Y, a drum cleaner 18Y, a discharge lamp 17Y, and a charging roller 16Y, which are arranged around the photoreceptor drum.

In this example, a photoreceptor drum having a drum made of a metal such as aluminum, and a photosensitive layer, which is formed on the drum and includes an organic photosensitive material, is used for the photoreceptor 3Y. However, the form and materials of the photoreceptor 3 are not limited thereto, and thus, for example, endless photoreceptors can also be used therefor.

The developing device 4Y develops an electrostatic latent image on the photoreceptor 3Y with either a two-component developer including a magnetic carrier and a nonmagnetic yellow toner or a one-component developer including a yellow toner and no carrier. Referring to FIG. 6, the developing device 4Y includes an agitator 5Y agitating and feeding the developer in the developing device, and a developing portion 9Y configured to develop an electrostatic latent image on the photoreceptor 3Y.

The agitator 5Y is located below the developing potion 9Y, and has a first feeding screw 6Y, a second feeding screw 7Y, a partition formed between the feeding screws, a toner concentration sensor 8Y provided at the bottom of a casing of the developing device 4Y.

The developing portion 9Y includes a developing roller 10Y opposed to the photoreceptor 3Y through an opening of the casing of the developing device 4Y, and a doctor blade 13Y whose tip portion is opposed to the surface of the developing roller with a gap therebetween. The developing roller 10Y includes a cylindrical developing sleeve 11Y made of a nonmagnetic material, and a magnet roller 12Y fixedly set inside the developing sleeve. The magnet roller 12Y has plural magnetic poles arranged in the circumferential direction of the developing roller. These magnetic poles apply magnetic forces to the developer present on the sleeve 11Y and opposed to the magnetic poles, and thereby the developer fed from the agitator 5Y is drawn so as to be born on the surface of the sleeve while forming a magnetic brush on the surface of the sleeve along magnetic force lines.

When the magnetic brush is fed by the rotated sleeve 11Y and passes through the position at which the sleeve is opposed to the doctor blade 13Y, the magnetic brush is regulated so as to have a proper thickness, and is then fed to the development region in which the sleeve is opposed to the photoreceptor 3Y. In the development region, the yellow (Y) toner included in the magnetic brush is transferred to an electrostatic latent image due to potential difference between the development bias applied to the sleeve 11Y and the electrostatic latent image on the photoreceptor 3Y. Thereafter, the developer forming the magnetic brush is returned to the developing portion 9Y due to rotation of the sleeve 11Y. The developer is then released from the surface of the sleeve 11Y by a repulsive magnetic field formed between magnetic poles of the magnet roller 12Y, resulting in returning to the agitator 5Y. In the agitator 5Y, a proper amount of toner is supplied to the developer depending on the toner concentration of the developer measured with the toner concentration sensor 8Y.

In this example, a cleaner, which has a cleaning blade 20Y made of polyurethane rubber and pressed to a surface of the photoreceptor 3Y, is used for the drum cleaner 18Y, but the drum cleaner is not limited thereto. In order to enhance the cleanability of the drum cleaner 18Y, a fur brush 19Y, which is rotated in a direction indicated by an arrow illustrated in FIG. 6, is provided so as to be contacted to the circumferential surface of the photoreceptor 3Y. In this regard, the fur brush 19Y also serves as a lubricant applicator, which scrapes off a solid lubricant (not shown) to apply the lubricant powder to the surface of the photoreceptor 3Y.

The toner adhered to the fur brush 19Y is transferred onto an electrostatic roller 21Y, which is contacted to the fur brush while rotated in the counter direction and to which a bias voltage is applied. The toner adhered to the electrostatic roller 21Y is scraped off by a scraper 22Y, so that the toner falls onto a collection screw 23Y.

The collection screw 23Y feeds the collected toner in a direction perpendicular to the paper sheet on which FIG. 6 is printed so that the toner is fed to the inner end portion of the drum cleaner 18Y, and is transported to an external recycling device (not shown). The recycling device feeds the collected toner to the developing device 4Y to reuse the toner for development.

The discharging lamp 17Y irradiates the surface of the photoreceptor 3Y with light to reduce charges remaining thereon even after the transfer and cleaning processes. The surface of the photoreceptor 3Y is then charged evenly with the charging roller 16Y, followed by optical scanning (i.e., irradiation of laser beam L) with the optical writing unit 50 to form an electrostatic latent image on the surface of the photoreceptor. In this regard, the charging roller 16Y is rotated while receiving a charge bias voltage from a power source (not shown). Instead of such a charging roller, a non-contact charger such as scorotron chargers can be used for charging the photoreceptor 3Y.

By performing the above-mentioned image forming process in each of the process units 2Y, 2M, 2C and 2K (illustrated in FIG. 5), yellow (Y), magenta (M), cyan (C) and black (K) toner images are formed on the respective photoreceptors 3Y, 3M, 3C and 3K.

Referring back to FIG. 5, the transferring unit 60 is provided below the four process units 2Y, 2M, 2C and 2K. In this transferring unit 60, the endless intermediate transfer belt 61, which is tightly stretched across plural rollers, is contacted to the four photoreceptors 3Y, 3M, 3C and 3K while rotated in a direction indicated by an arrow by a driving roller 67. Therefore, four primary transfer nips for transferring yellow, magenta, cyan and black toner images are formed between the four photoreceptors 3 and the intermediate transfer belt 61.

At the primary transfer nips, primary transfer rollers 62Y, 62M, 62C and 62K, which are provided inside the loop of the intermediate transfer belt 61, press the intermediate transfer belt so as to be contacted to the photoreceptors 3Y, 3M, 3C and 3K. In this regard, a primary transfer bias voltage is applied to each of the four primary transfer rollers 62 to form a primary transfer electric field in the primary transfer nips, thereby electrostatically transferring Y, M, C and K toner images from the photoreceptors 3Y, 3M, 3C and 3K to the intermediate transfer belt 61.

Thus, Y, M, C and K toner images on the photoreceptors 3Y, 3M, 3C and 3K are primarily transferred one by one onto the outer surface of the intermediate transfer belt 61, which is rotated in the direction indicated by the arrow, at the Y, M, C and K primary transfer nips, thereby forming a combined color toner image, in which four color toner images are overlaid, on the intermediate transfer belt.

Referring again to FIG. 5, a secondary transfer roller 72 is arranged below the intermediate transfer belt 61. The secondary transfer roller 72 is contacted to the surface of the intermediate transfer belt 61, which is pressed from the inside thereof by an opposing roller 68, thereby forming a secondary transfer nip. In this regard, a power source (not shown) applies a secondary transfer bias voltage to one of the opposing roller 68 located inside the loop of the intermediate transfer belt 61 and the secondary transfer roller 72 located outside the loop, wherein the other roller is grounded. Thus, a secondary transfer electric field is formed in the secondary transfer nip.

Referring back to FIG. 4, the pair of registration rollers 37 is provided on the right side of the secondary transfer nip. The pair of registration rollers 37 timely feeds the receiving sheet P toward the secondary transfer nip so that the combined color toner image on the intermediate transfer belt 61 is transferred onto a proper position of the receiving sheet. Since the secondary transfer electric field is formed and the nip pressure is applied in the secondary transfer nip, the combined color toner image on the intermediate transfer belt 61 is secondarily transferred onto the receiving sheet P, resulting in formation of the combined color toner image (a full color image) on the (white) receiving sheet.

Even after the secondary transfer process, a part of the combined toner image remains on the outer surface of the intermediate transfer belt 61 without being transferred. A belt cleaner 73 is provided so as to contact the surface of the intermediate transfer belt 61 to remove the residual toner therefrom.

Referring again to FIG. 4, the receiving sheet P passing through the secondary transfer nip is then released from the intermediate transfer belt 61 to be transferred to the feed belt unit 39. The feed belt unit 39 includes an endless feed belt 40, a driving roller 41, and a driven roller 42, wherein the feed belt is rotated by the driving roller in a direction indicated by an arrow while tightly stretched by the rollers 41 and 42. The feed belt 40 makes endless movement to feed the receiving sheet, which is fed from the secondary transfer nip and which bears a full color image thereon, to the fixing unit 43.

The fixing unit 43 has a driving roller, a heat roller having a heat source therein, an endless fixing belt 44, which is rotated by the driving roller while tightly stretched by the rollers, and a pressure roller 45, which is provided so as to be contacted to the fixing belt to form a fixing nip. The receiving sheet P entering the fixing unit 43 is pressed and heated at the fixing nip, resulting in fixation of the full color image on the receiving sheet. The receiving sheet P is then discharged from the fixing unit 43 toward the switching pick 49.

The switching pick 49 can be swung by a solenoid (not shown) to switch the feeding passage of the receiving sheet from a discharge passage to a reverse passage or vice versa. When the discharge passage is selected by the switching pick 49, the receiving sheet P fed from the fixing unit 43 is discharged from the main body of the copier by the pair of discharging rollers 47 so as to be stacked on the discharge tray 48.

The switchback device 46 is arranged below the fixing unit 43 and the feed belt unit 39. When the reverse passage is selected by the switching pick 49 (i.e., when a double-sided copy is formed), the receiving sheet P fed from the fixing unit 43 is fed to the reverse passage, and is then fed to the secondary transfer nip by the switchback device 46. After another toner image is transferred on the backside of the receiving sheet P at the secondary transfer nip, the image is fixed by the fixing device 43. Thus, a double-sided or duplex copy is formed.

Referring back to FIG. 3, the scanner 210 fixed on the printer section 1 includes a fixed reading portion 211, and a movable reading portion 212, each of which serves as a reading device for reading an image on an original (not shown). The fixed reading portion 211 includes a light source, reflection mirrors, an image reading sensor such as CCDs, etc., and is arranged directly below a first glass table (not shown), which is fixed on the upper wall of the casing of the scanner 210 so as to be contacted to an original document. When an original document fed from the ADF 250 passes the first glass table, the light source of the fixed reading portion emits light beams toward the original document. Light beams reflected from the original document via plural reflection mirrors are received by the image reading sensor. Thus, the fixed reading portion 211 scans the image on the original document without moving an optical device including a light source, reflection mirrors, etc.

In contrast, the movable reading portion 212 is arranged below a second glass table (not shown) fixed on the upper wall of the casing of the scanner 210 so as to be contacted to an original document, and has configuration such that an optical system including a light source, reflection mirrors, etc. is moved in the horizontal direction (i.e., rightward and leftward in FIG. 3). Specifically, in a process of rightward movement of the movable reading portion 212, the light source thereof emits light beams toward an original document (not shown) set on the second glass table, and the image reading sensor receives light beams reflected from the original document via the reflection mirrors. Thus, the movable reading portion 212 scans the image on an original document while moving the optical system.

In this copier, the four process units 2Y, 2M, 2C and 2K, optical writing unit 50; transfer unit 60, etc. constitute the image forming device configured to form an image on the receiving sheet P. In addition, the transfer unit 60 serves as a transferring device configured to transfer an image on the intermediate transfer belt 61 to the receiving sheet P.

The copier mentioned above has a facsimile capability as well as a copying function. Specifically, the image information read by the original document feeding/reading unit 200 can be sent to a facsimile over a phone line or the like.

Figure 7:
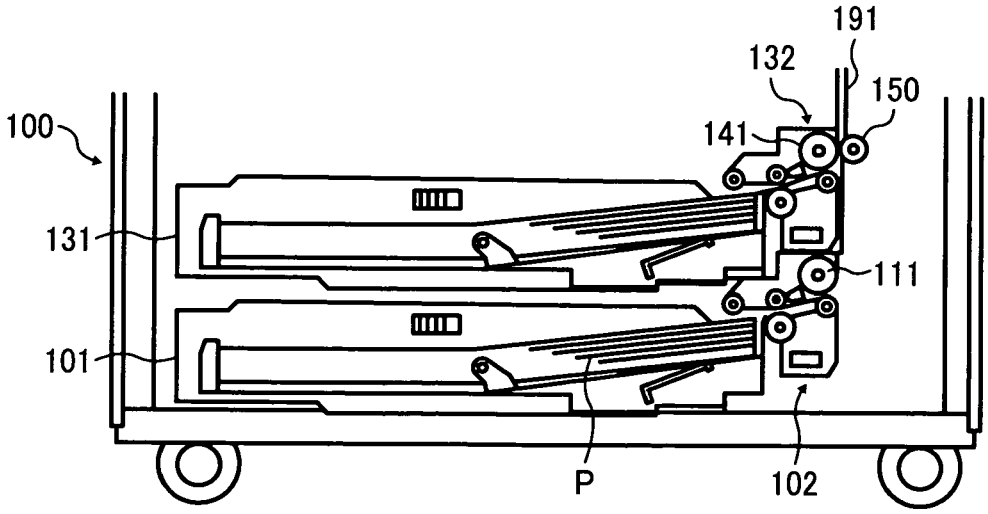
FIG. 7 is an enlarged view illustrating a lower portion of a sheet feeding device of the copier illustrated in FIG. 3.

FIG. 7 is an enlarged view illustrating the lower portion of the sheet feeding device 100 of the copier illustrated in FIG. 3. Referring to FIG. 7, the first roller unit 102 is provided on the right side of the first sheet cassette 101. In addition, the second roller unit 132 is provided on the right side of the second sheet cassette 131. Further, as illustrated in FIG. 3, the third roller unit 162 is provided on the right side of the large-capacity sheet cassette 161 located above the second sheet cassette 131. These roller units 102, 132 and 162 have substantially the same configuration except for the below-mentioned differences, including a difference such that the first roller unit 102 located on the extreme upstream side relative to the sheet feeding direction does not have a second driven roller.

Figure 8:
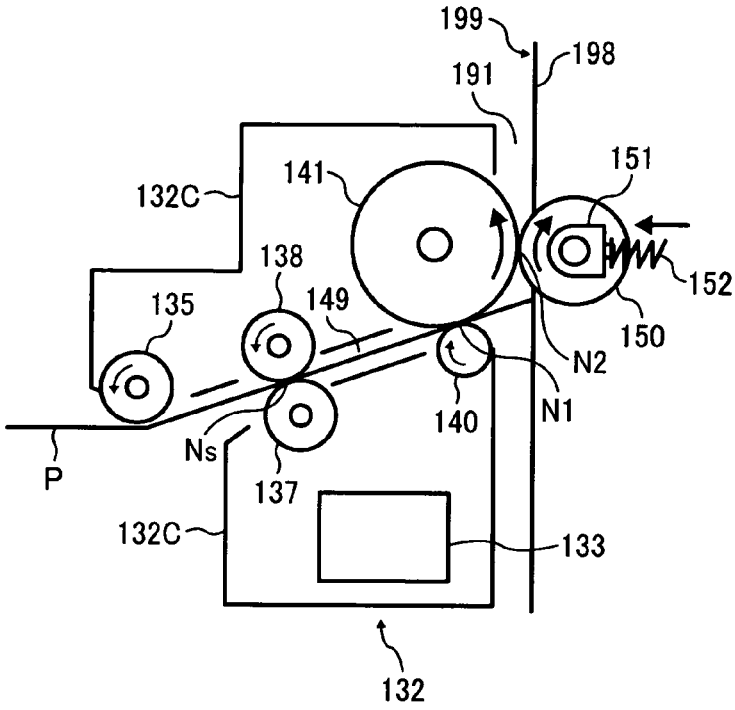
FIG. 8 is an enlarged view illustrating the second roller unit of the sheet feeding device illustrated in FIG. 7.

FIG. 8 is an enlarged view illustrating the second roller unit 132 of the sheet feeding device 100. The second roller unit 132 is a holding unit including a pickup roller 135, a reverse roller 137, a feed roller 138, a grip roller 141 serving as a driving rotor, a first driven roller 140 serving as a first driven rotor, and a sheet feeding motor 133, all of which are held in a case 132C, and a second driven roller 151 serving as a second driven rotor and arranged on the right side of the holding unit. The pickup roller 135, reverse roller 137 and feed roller 138 serve as a feeding member configured to feed a sheet to the first nip N1 formed by the grip roller 141 and the first driven roller 140. The holding unit can be detachably attached to the main body of the sheet feeding device 100.

The pickup roller 135 is pressed to the uppermost sheet of the stack of receiving sheets contained in the second sheet cassette 131. By rotating the pickup roller 135 in a direction indicated by an arrow (i.e., counterclockwise in FIG. 8), the uppermost sheet P is fed so as to enter the holding unit.

The reverse roller 137 and the feed roller 138 are arranged on the right side of the pickup roller 135. The reverse roller 137 arranged below the feed roller 138 is pressed toward the feed roller 138 by a pressing solenoid (not shown), thereby forming a separation nip Ns at which the reverse roller is contacted to the feed roller. The receiving sheet P fed from the second sheet cassette 131 by the pickup roller 135 and entering the holding unit is nipped at the separation nip.

The first driven roller 140 and the grip roller 141 are arranged on the right side of the separation nip. Specifically, the first driven roller 140 serving as a first driven rotor is arranged below the grip roller 141 serving as a driving rotor, and is biased toward the grip roller by a biasing member such as a spring (not shown), thereby forming the first nip N1. The receiving sheet P fed from the separation nip is then nipped at the first nip.

A guide unit 199 is arranged on the right side of the holding unit. The guide unit 199 has a guide plate 198 which is opposed to the holding unit of the second roller unit 132. Thus, the guide plate 198 and the holding unit, which are opposed to each other with a predetermined gap therebetween, constitute a lower portion of the vertical sheet feeding passage 191 serving as the straight sheet feeding passage.

The guide unit 199 slidably holds a bearing 151, which rotatably bears the second driven roller 150 of the second roller unit 132, in such a manner that the bearing can slide in a range of from a first position at which the bearing is relatively close to the grip roller 141 to a second position at which the bearing is relatively far from the grip roller. In addition, the bearing 151 is pressed toward the grip roller 141 by a coil spring 152 serving as a biasing member, thereby contacting the second driven roller 150 to the grip roller at a predetermined pressure, resulting in formation of the second nip N2.

Referring to FIG. 8, a feeding passage 149 rising slightly toward the vertical sheet feeding passage 191 is formed in the first roller unit 132 to feed the receiving sheet P to the vertical sheet feeding passage.

Figure 9:
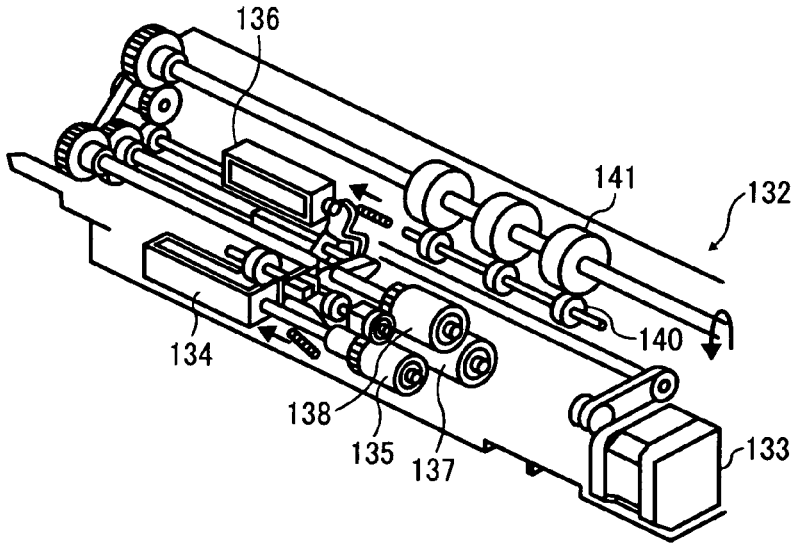
FIG. 9 is an exploded perspective view of the second roller unit when the unit is observed from one end in the longitudinal direction thereof.
Figure 10:
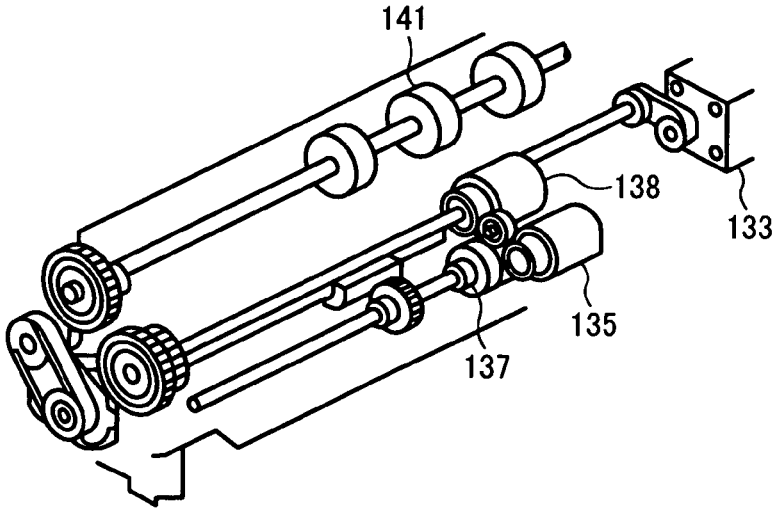
FIG. 10 is a perspective view of the second roller unit when the unit is observed from the other end in the longitudinal direction thereof.
Figure 11:
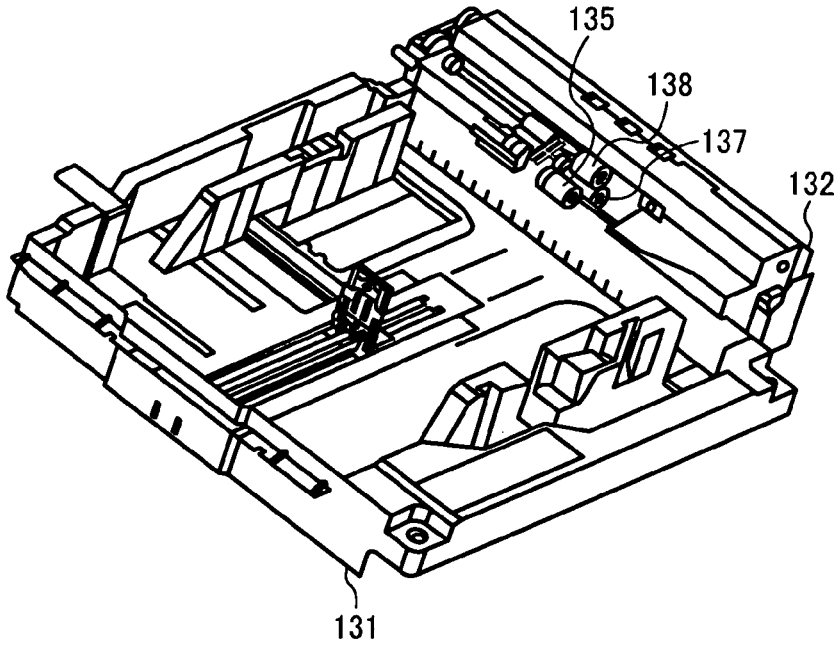
FIG. 11 is a perspective view illustrating the second roller unit together with the second sheet cassette of the sheet feeding device illustrated in FIG. 7.

FIG. 9 is an exploded perspective view of the second roller unit 132 when the unit is observed from one end thereof in the longitudinal direction thereof. FIG. 10 is an exploded perspective view of the second roller unit 132 when the unit is observed from the other end in the longitudinal direction thereof. FIG. 11 is a perspective view illustrating the second roller unit 132 together with the second sheet cassette 131.

Referring to FIGS. 9-11, when the receiving sheet P is fed from the second sheet cassette 132, at first a pickup solenoid 134 is driven to press the pickup roller 135 to the receiving sheet P set on the second sheet feed cassette 131. In addition, the pressing solenoid 136 is driven to press the reverse roller 137 to the feed roller 138. In this regard, the sheet feeding motor 133 is reversely rotated, thereby rotating the pickup roller 135 in a direction indicated by an arrow in FIG. 12. Therefore, the receiving sheet P is fed toward the separation nip formed by the reverse roller 137 and the feed roller 138.

Figure 12:
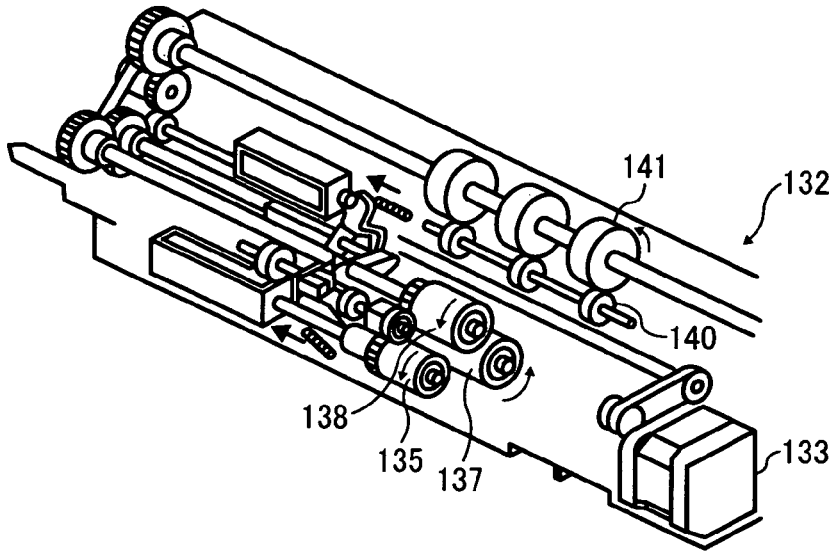
FIG. 12 is a perspective view illustrating how the rollers of the second roller unit rotate when the feed roller is reversely rotated.

In addition, the feed roller 138 is rotated in a direction indicated by an arrow illustrated in FIG. 12 to feed the receiving sheet P, which is nipped at the separation nip, to the vertical sheet feeding passage 191 (illustrated in FIG. 8). In this case, the reverse roller 137 directly contacted to the feed roller 138 is rotated clockwise while driven by the feed roller 138. However, when two or more receiving sheets are nipped at the separation nip at the same time, a torque limiter (not shown) is activated to connect a reverse driving force to the reverse roller 137. In this case, the reverse roller 137 is rotated counterclockwise (i.e., in a direction indicated by an arrow illustrated in FIG. 12), thereby returning the lower receiving sheet or sheets (i.e., receiving sheet(s) except for the uppermost sheet) to the second sheet cassette 131.

After the receiving sheet P passes the separation nip formed by the reverse roller 137 and the feed roller 138, the front edge of the receiving paper P is detected by a sheet detector (not shown) before the sheet enters the first nip formed by the first driven roller 140 and the grip roller 141. When the sheet detection is made, a controller (not shown) equipped with a central processing unit (CPU) serving as a processing device, a random access memory (RAM) serving as a data storage device, and a read only memory (ROM) serving as a data storage device, turns off the pickup solenoid 134 to separate the pickup roller 135 from the stack of receiving sheets in the second sheet cassette 131, thereby reducing the feeding torque.

Figure 13:
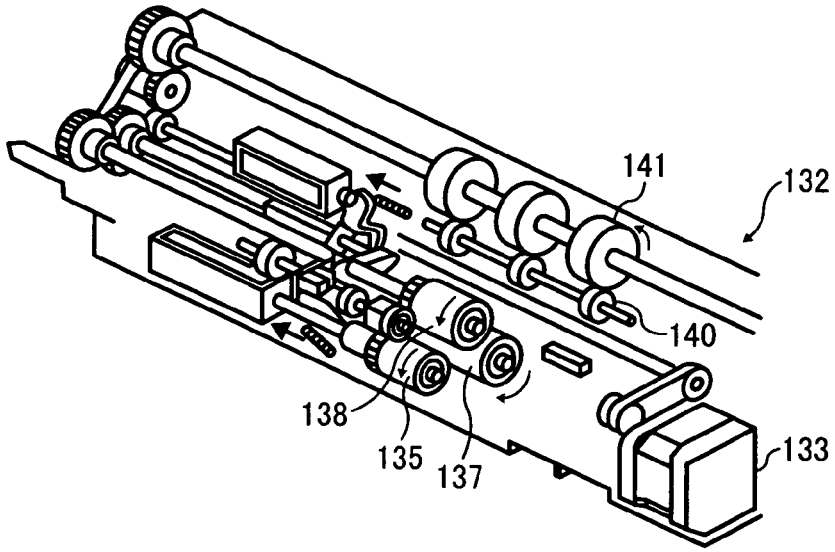
FIG. 13 is a perspective view illustrating how the rollers of the second roller unit rotate when the feed roller is normally rotated.

In addition, the controller switches the driving direction of the sheet feeding motor 133 from the reverse direction to the normal direction so that the rollers are rotated in the directions indicated by the arrows illustrated in FIG. 13. Specifically, the rotation directions of the pickup roller 135, feed roller 138 and grip roller 141 are the same as the directions thereof when the sheet feeding motor 133 is reversely rotated, i.e., the rollers are rotated in such directions that the receiving sheet P is fed to the vertical sheet feeding passage, but the rotation direction of the reverse roller 137 is changed to the reverse rotation. More specifically, when the sheet feeding motor 133 is reversely rotated and in addition the torque limiter is activated, the reverse roller 137 is rotated counterclockwise. However, when the sheet feeding motor 133 is normally rotated, the reverse roller 137 is clockwise rotated as illustrated in FIG. 12. Thereby, the receiving sheet P can be smoothly fed to the vertical sheet feeding passage.

Figure 14:
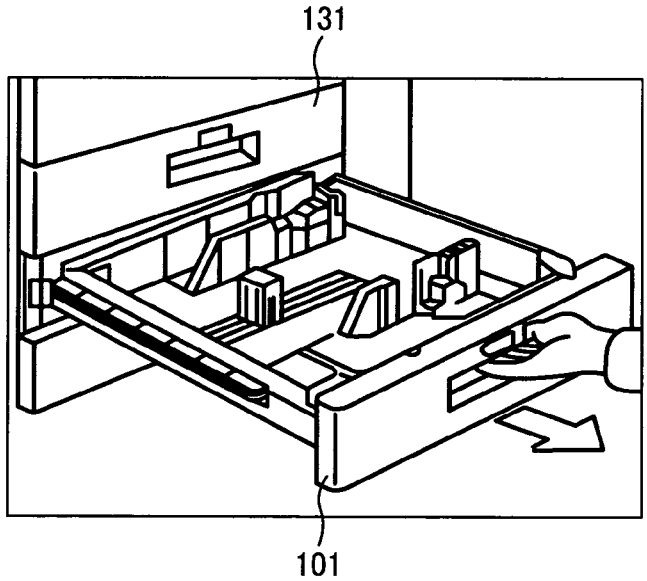
FIG. 14 is a partial enlarged perspective view of the image forming apparatus illustrating the operation of drawing the sheet feeding cassette.

FIG. 14 is an enlarged perspective view for explaining the sheet cassette drawing operation. As illustrated in FIG. 14, one of the sheet cassettes, the first sheet cassette 101, is drawn from the main body of the sheet feeding device while perfectly separated from the first roller unit 102 (illustrated in FIG. 3). In this regard, the drawing direction is the direction of from the inner side to the front side in the direction perpendicular to the paper sheet on which FIG. 7 is printed.

Figure 15:
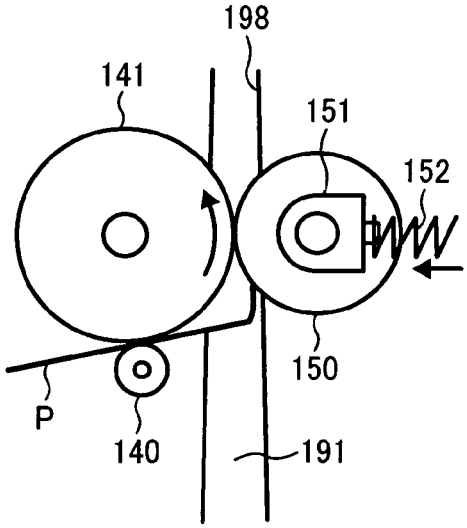
FIG. 15 is an enlarged schematic view illustrating a sheet striking the second driven roller of the second roller unit.

As mentioned above with reference to FIG. 8, after the receiving sheet P passes the first nip formed by the first driven roller 140 and the grip roller 141 in the second roller unit 132, the tip of the sheet P enters the vertical sheet feeding passage 191 and strikes the guide plate 198 of the guide unit 199. In this regard, when the receiving sheet P is further fed into the vertical feeding passage 191, the tip of the receiving sheet is sharply curved so that the tip faces upward and strikes the second driven roller 150 as illustrated in FIG. 15. If the receiving sheet P is a thick paper sheet having a high stiffness, the following problem tends to occur. Specifically, the second driven roller 150 is moved in such a direction as to be separated from the grip roller 141 against the biasing force of the coil spring 152. In this case, the second driven roller 150 cannot be well rotated by the grip roller 141, or is stopped, thereby stopping the tip of the receiving sheet P at the second driven roller, resulting in occurrence of the sheet jamming problem.

Next, a characteristic configuration of the copier, which is an embodiment of the present invention, will be described.

Figure 16:
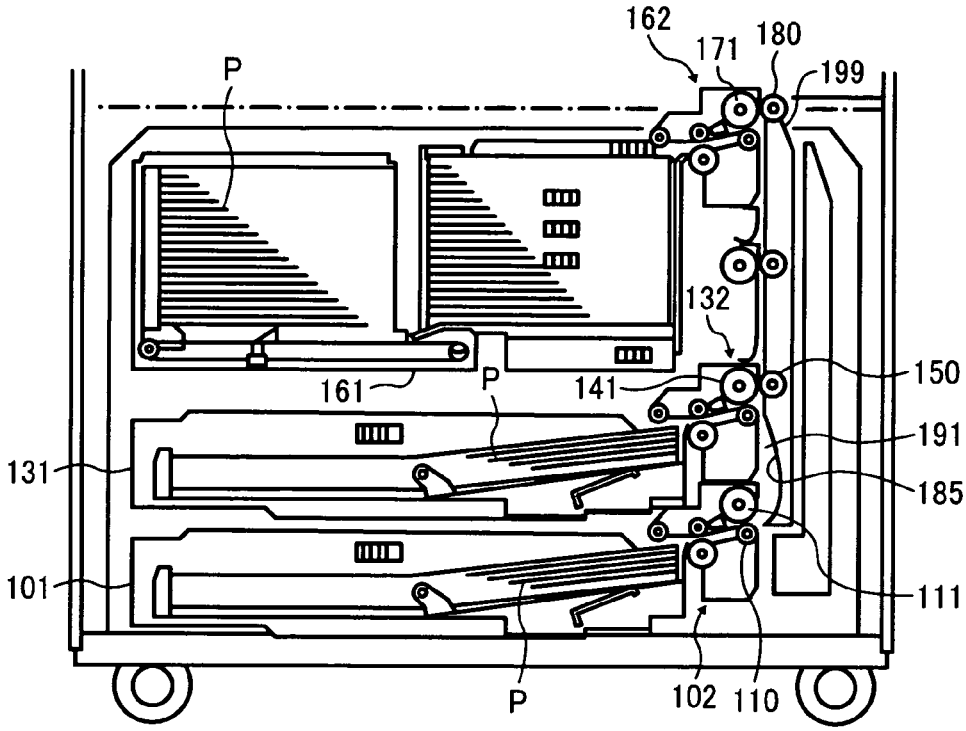
FIG. 16 is a schematic view illustrating the sheet feeding device of the copier illustrated in FIG. 3.

FIG. 16 is a schematic view illustrating the sheet feeding device 100 of the copier. Referring to FIG. 16, among the first, second and third sheet feeding sections, only the first sheet feeding section located on the extreme upstream side relative to the sheet feeding direction has no second driven roller. Instead of providing a second driven roller, a curved guide portion 185 is provided on the right side of a grip roller 111 of the first roller unit 102 in such a manner as to face the grip roller with a predetermined gap and forms a portion (i.e., a passage 185P) of the vertical sheet feeding passage 191 together with the grip roller. The curved guide portion 185 guides the receiving sheet P, which is fed from a first nip N1' formed by the grip roller 111 and a first driven roller 110, so as to pass through the passage 185P, thereby guiding the sheet to the second nip N2 of the second roller unit 132.

Figure 17:
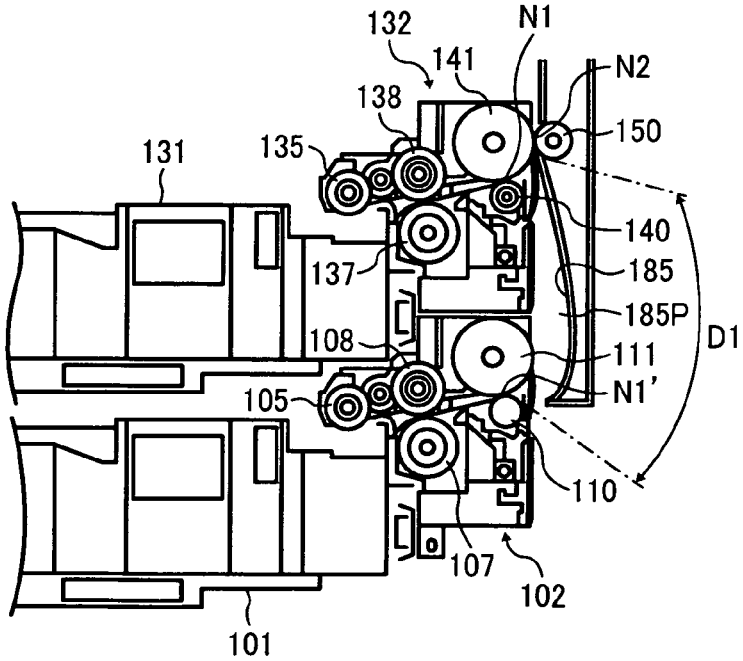
FIG. 17 is an enlarged view illustrating the first and second roller units of the sheet feeding device illustrated in FIG. 16.

It can be understood from FIG. 17 that the receiving sheet P passing through the passage 185P has a larger curvature radius than the receiving sheet sharply curved by the second driven roller 150 in the second roller unit 132. Since the receiving sheet P passing through the curved passage 185P is gradually curved so as to face upward, it becomes possible to easily change the feeding direction of the receiving sheet so as to face upward even when the sheet is relatively thick. Since the space for use in providing a second driven roller is used for the curved guide portion 185 as illustrated in FIG. 17, the sheet feeding device is not increased in size. Namely, the sheet jamming problem occurring when a thick paper sheet is used for the receiving sheet P can be avoided without enlarging the sheet feeding device and copier.

In this copier, the receiving sheet P striking the second driven roller 150 and sharply curved thereby at the junction of the feeding passage of the second roller unit 132 and the vertical sheet feeding passage 191 has a curvature radius of 20 mm, but the portion of the curved guide portion 185 having the maximum curvature (i.e., 1/r) has a curvature radius of 50 mm. Therefore, a thick paper sheet having a weight of 256 $g/m^2$ can be smoothly curved by the curved guide portion 185. By increasing the curvature radius of the curved guide portion 185 to 70 mm, a thicker paper sheet having a weight of 300 $g/m^2$ can be smoothly curved thereby without causing the sheet jamming problem.

In FIG. 17, reference character D1 denotes the sheet moving distance. Specifically, the sheet moving distance D1 is a distance of a path of the sheet in the passage 185P, along which the receiving sheet P is fed from the first nip N1' formed by the grip roller 111 and the first driven roller 110 to the second nip N2 of the second roller unit 132. The sheet moving distance D1 is preferably shorter than a sheet having the shortest length in the sheet feeding direction among the receiving sheets settable in the first sheet cassette 101, so that such a small-sized sheet can be securely fed to the second nip N2 of the second roller unit 132 while pinched at the first nip N1' of the first roller unit 102.

In this copier, the length of the receiving sheet P having the minimum length in the sheet feeding direction among the receiving sheets settable in the first sheet cassette 101 is 5.5 inch (139.7 mm), and the sheet moving distance D1 is 125 mm.

Next, another example (copier) of the sheet feeding device of the present invention will be described.

Figure 18:
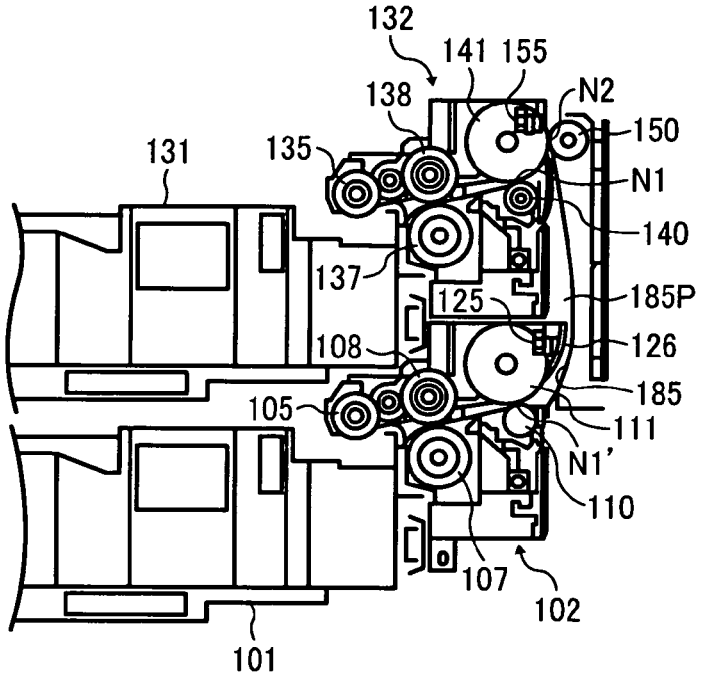
FIG. 18 is an enlarged view illustrating the first and second roller units of another example of the sheet feeding device.

FIG. 18 is an enlarged view illustrating the first roller unit 102 and the second roller unit 132 of the sheet feeding device. Referring to FIG. 18, a guide portion 126 is provided on the casing 132C of the first roller unit 102. The guide portion 126 is projected toward the curved guide portion 185 so that a gap is formed therebetween. Therefore, the receiving sheet P can be smoothly guided along the curved guide portion 185 while passing through the gap.

Specifically, by forming the guide portion 126, flapping of the receiving sheet P in the horizontal direction in the passage 185P can be reduced. In order to detect a sheet jam in the passage 185P or to determine the sheet feed timing therein, a sheet detection sensor 125 is arranged at a location on the guide portion 126 in the vicinity of the grip roller 111. By reducing fluttering of the receiving sheet P, chance of misdetection of the receiving sheet by the sheet detection sensor 125 can be reduced.

Figure 19:
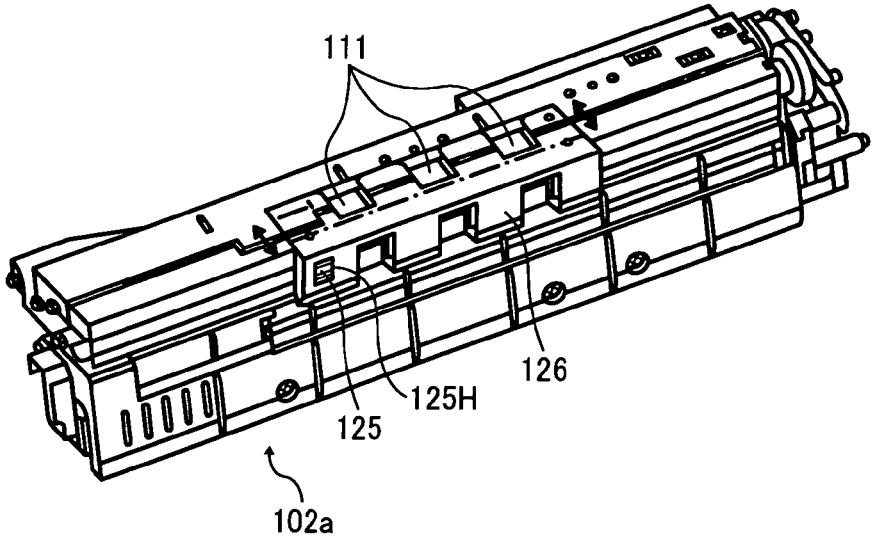
FIG. 19 is a perspective view illustrating a holding unit holding the first roller unit of the sheet feeding device illustrated in FIG. 18.

FIG. 19 is a perspective view illustrating a holding unit 102*a* holding the first roller unit 102 of the sheet feeding device. The above-mentioned guide 126 is held by the casing of the holding unit 102*a* while being slidable in directions indicated by a double-headed arrow shown in the drawing. Specifically, the guide portion 126 is slidable in such directions as to approach to or withdraw from the grip roller 111 (i.e., to withdraw from or approach to the curved guide portion 185). A user or service person can fix the guide portion 126 by fastening the guide portion to the casing of the first roller unit 102 after positioning the guide portion to any position in the directions indicated by the double-headed arrow. By thus performing the positioning operation, the gap between the curved guide portion 185 and the guide portion 126 can be adjusted so as to be suitable for the thickness of the receiving sheets which the user frequently uses, i.e., the gap can be adjusted to a desired gap at which jamming of the receiving sheets which the user frequently uses can be prevented.

The above-mentioned sheet detection sensor 125 is located at a location relatively close to the grip roller 111 compared to the guide portion 126, but the receiving sheet P is located at a location relatively close to the curved guide portion 185 compared to the guide portion 126. Therefore, it is difficult to detect the receiving sheet P with the sheet detection sensor 125 because the guide portion 126 interferes with the sheet detection operation of the sensor. In this copier, an opening 125H is provided on the guide portion 126 as illustrated in FIG. 19 so that the sheet detection operation can be made through the opening. Since the sheet detection sensor 125 is fixed on the guide portion 126 and therefore the position of the sensor relative to the guide portion is fixed, the sheet detection operation can be securely performed through the opening regardless of the position of the guide portion in the directions indicated by the double-headed arrow, to which the guide portion is set.

As mentioned above, in the first sheet feeding device 100 of the copier, the sheet moving distance D1 in the passage 185P extending from the first nip N1' of the first roller unit 102 (i.e., the roller unit located on the extreme upstream side relative to the sheet feeding direction) to the second nip N2 of the second roller unit 132 is shorter than the length of the receiving sheet having the shortest length in the sheet feeding direction among receiving sheets settable in the first sheet cassette 101. Therefore, even such a small-sized receiving sheet can be securely fed to the second nip N2 of the second roller unit 132 while being pinched at the first nip N1' of the first roller unit 102.

In the second example of the sheet feeding device 100 mentioned above, the guide portion 126 is provided on the holding unit 102*a* of the first roller unit 102 to guide the receiving sheet P through the gap formed by the guide portion and the curved guide portion 185. In this sheet feeding device, fluttering of the receiving sheet P fed along the curved guide portion 185 can be reduced, thereby reducing chance of misdetection of the receiving sheet by the sheet detection sensor 125.

In the second sheet feeding device 100, the guide portion 126 can be slidable in such directions as to approach to or withdraw from the grip roller 111 of the first roller unit 102. By adjusting the gap between the guide portion 126 and the curved guide portion 185 depending on the thickness of the receiving sheets which the user frequently uses, chance of occurrence of the sheet jamming problem can be reduced.

In addition, in the above-mentioned second example of the sheet feeding device 100, the sheet detection sensor 125 is fixed to the guide portion 126 so as to be movable together with the guide portion while the opening 125H is formed in the guide portion. Therefore, the sheet detection operation can be securely performed through the openings regardless of the position of the guide portion 126.

As mentioned above, in sheet feeding device of the present invention, only the sheet feeding section located on the extreme upstream side relative to the sheet feeding direction has a curved guide portion, which is provided instead of the second driven rotor thereof and along which a sheet is directly fed to the second nip of the adjacent sheet feeding section so that the sheet is curved while having a curvature radius greater than the curvature radius of the sheet fed from the other sheet feeding sections to the second nip thereof. Therefore, even when a thick sheet is used, it becomes possible to gradually change the feeding direction of the thick sheet, thereby securely feeding such a thick sheet. Since the space for use in providing a second driven roller is used for the curved guide portion, the sheet feeding device is not increased in size. Namely, the sheet jamming problem occurring when a thick sheet is used for the sheet P can be avoided without enlarging the sheet feeding device.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-195076 and 2010-121467, filed on Aug. 26, 2009, and May 27, 2010, respectively, the entire contents of which are herein incorporated by reference.

What is claimed is:

1. A sheet feeding device comprising:

plural sheet feeding sections for containing a stack of sheets and feeding a sheet, each of the plural sheet feeding sections including a sheet container containing the stack of sheets, a driving rotor, a first driven rotor contacted to the driving rotor to form a first nip, a feeding member configured to feed the sheet from the sheet container toward the first nip, and a second driven rotor contacted to the driving rotor or the first driven rotor to form a second nip; and a straight sheet feeding passage configured to feed the sheet, which is fed from the plural sheet feeding sections, in a sheet feeding direction, wherein the straight sheet feeding passage shares the second nips with the plural sheet feeding sections, wherein when the sheet fed through the first nip enters the straight sheet feeding passage and strikes the second driven rotor in each of the plural sheet feeding sections, the sheet is guided to the second nip thereof by the second driven rotor while curved thereby, so that the sheet is fed through the straight sheet feeding passage toward a downstream side thereof relative to the sheet feeding direction, and wherein among the plural sheet feeding sections, only the sheet feeding section located on an extreme upstream side relative to the sheet feeding direction does not have the second driven rotor, and further includes a curved first guide portion, along which the sheet fed from the first nip of the sheet feeding section is directly fed to the second nip of the adjacent sheet feeding section so that the sheet is curved at the curved guide portion while having a greater curvature radius than the sheet fed from the other sheet feeding sections toward the respective second nips.

2. The sheet feeding device according to claim 1, wherein a sheet moving distance of from the first nip of the sheet feeding section on the extreme upstream side to the second nip of the adjacent sheet feeding section along the curved guide portion is shorter than a shortest length in the sheet feeding direction of the sheets settable in the sheet container of the sheet feeding section on the extreme upstream side.

3. The sheet feeding device according to claim 1, wherein the sheet feeding section on the extreme upstream side further includes a second guide portion, which forms a gap with the curved first guide portion so that the sheet fed from the first nip of the sheet feeding section is guided to pass through the gap.

4. The sheet feeding device according to claim 3, wherein the second guide portion is movable in a range in such directions as to approach to or withdraw from the driving rotor or the first driven rotor of the sheet feeding section on the extreme upstream side, the second guide portion fixable at any position in the movable range.

5. The sheet feeding device according to claim 4, wherein the sheet feeding section on the extreme upstream side further includes a sheet detection sensor configured to detect the sheet, wherein the sheet detection sensor is fixed on the second guide portion so as to be movable together with the guide portion.

6. An image forming apparatus comprising:

the sheet feeding device according to claim 1; and an image forming device configured to form a visual image on the sheet fed from the sheet feeding device.

* * * * *